US006886199B1

(12) United States Patent
Schwaegerle

(10) Patent No.: US 6,886,199 B1
(45) Date of Patent: May 3, 2005

(54) SURGICAL TABLE

(75) Inventor: Gary G. Schwaegerle, Cincinnati, OH (US)

(73) Assignee: Reliance Medical Products, Inc., Mason, OH (US)

( * ) Notice: Subject to any disclaimer, the term of this patent is extended or adjusted under 35 U.S.C. 154(b) by 22 days.

(21) Appl. No.: 10/672,619

(22) Filed: Sep. 26, 2003

Related U.S. Application Data

(62) Division of application No. 10/068,592, filed on Feb. 5, 2002, now Pat. No. 6,721,976.

(51) Int. Cl.[7] ..... A61G 7/008

(52) U.S. Cl. ..... 5/607; 5/507.1; 5/600; 5/610; 5/620

(58) Field of Search ..... 5/600–601, 607, 5/610–611, 616, 620, 507.1

(56) References Cited

U.S. PATENT DOCUMENTS

| | | | | |
|---|---|---|---|---|
| 4,761,000 | A | 8/1988 | Fisher et al. | 269/323 |
| 4,811,435 | A | 3/1989 | Foster et al. | 5/60 |
| 4,847,929 | A | 7/1989 | Pupovic | 5/62 |
| 4,860,394 | A | 8/1989 | Benessis et al. | 5/62 |
| 4,872,657 | A | 10/1989 | Lussi | 269/325 |
| 4,958,817 | A | 9/1990 | Heller et al. | 269/323 |
| 4,960,271 | A | 10/1990 | Sebring | 269/323 |
| 5,023,967 | A | 6/1991 | Ferrand | 5/62 |
| 5,088,706 | A | 2/1992 | Jackson | 269/323 |
| 5,125,122 | A | 6/1992 | Chen | 5/618 |
| 5,131,105 | A | 7/1992 | Harrawood et al. | 5/607 |
| 5,131,106 | A | 7/1992 | Jackson | 5/613 |
| 5,156,166 | A | 10/1992 | Sebring | 128/845 |
| 5,208,928 | A | 5/1993 | Kuck et al. | 5/608 |
| 5,230,112 | A | 7/1993 | Harrawood et al. | 5/607 |
| 5,230,113 | A | 7/1993 | Foster et al. | 5/608 |
| 5,299,334 | A | 4/1994 | Gonzalez | 5/607 |
| 5,398,356 | A | 3/1995 | Pfleger | 5/608 |
| 5,418,990 | A | 5/1995 | Risasen | 5/608 |
| 5,515,561 | A | 5/1996 | Suggitt et al. | 5/607 |
| 5,528,782 | A | 6/1996 | Pfeuffer et al. | 5/611 |
| 5,590,429 | A | 1/1997 | Boomgaarden et al. | 5/600 |
| 5,621,933 | A | 4/1997 | Knapp et al. | 5/608 |
| 5,640,729 | A | 6/1997 | Marino | 5/607 |
| 5,742,962 | A | 4/1998 | Yoshino et al. | 5/623 |
| 5,802,640 | A | 9/1998 | Ferrand et al. | 5/617 |
| 5,860,899 | A | 1/1999 | Rassman | 482/142 |
| 6,038,718 | A | 3/2000 | Pennington et al. | 5/618 |
| 6,721,976 | B2 * | 4/2004 | Schwaegerle | 5/607 |

* cited by examiner

*Primary Examiner*—Heather Shackelford
*Assistant Examiner*—Fredrick Conley
(74) *Attorney, Agent, or Firm*—Wood, Herron & Evans, L.L.P.

(57) ABSTRACT

A surgical table which includes a patient support surface 16 for receiving a patient, a vertically-movable support column connected to and supporting the patient support surface, and a pair of four-bar linkages for laterally tilting patient support surface relative to the support column. The support column includes a base that is mounted for vertical movement between a first position in which the surgical table is movable on rollers and a second position wherein the base contacts the floor to lock the position of the surgical table during a procedure. One or more trays may be pivotally connected to the patient support surface and selectively deployed to hold objects such as surgical instruments.

9 Claims, 10 Drawing Sheets

SURGICAL TABLE

CROSS-REFERENCE TO RELATED APPLICATIONS

This application is a divisional of application Ser. No. 10/068,592, filed Feb. 5, 2002 and now U.S. Pat. No. 6,721,976, the disclosure of which is fully incorporated herein by reference.

FIELD OF THE INVENTION

The present invention generally relates to apparatus for supporting patients during medical procedures and, more specifically, to surgical tables having improved patient access and a stable floor locking mechanism.

BACKGROUND OF THE INVENTION

Conventional surgical and medical tables are designed to provide a support platform for holding patients in an appropriate position during surgery or a procedure. Floor space in hospital and out-patient operating rooms is at a premium. Therefore, the design of the surgical table must afford surgical team members ready access to various body parts of the patient from various locations along the table before, during or after the surgical or medical procedure and yet minimize the amount of floorspace occupied.

During the surgical or medical procedure, the patient must be maintained stationary. To that end, the surgical table is anchored to the floor in a fixed position within the operating room or procedure room. However, the surgical table must be movable so that it can be repositioned within the operating room or removed from the operating room when unused. The surgical table is repositioned to clean the floor space about the table following the medical procedure. The surgical table may require repositioning to introduce a different surgical table, which is tailored for a specialized procedure, into the operating room.

Conventional medical or surgical tables are mobilized by providing them with multiple pivoting or swivel casters. In one common design for anchoring the position of the surgical table, a plurality of retractable, vertically-movable floor locks are extended to contact the floor. The casters may remain in floor contact or the floor locks may raise the table so that the casters no longer contact the floor. In an elevated position, the table is supported on the legs rather than on the casters. However, such conventional mechanisms are mechanically complex because a set of vertically movable legs must be incorporated into the table design.

The patient support surfaces of conventional surgical tables may only be lowered to within about thirty-one inches of the floor. Because the patient not conveniently located, surgical team members must stand during surgical procedures, which increases fatigue. For certain types of surgeries, it would be advantageous for surgical team members to operate in a seated position.

Surgical team members must work in a dose proximity to the patient. If the support surface is significantly wider that the width of the patient's body, then the surgical team members cannot stand near to the patient's body. Users of conventional surgical tables, however, commonly utilize portions of the support surface adjacent to the patient's shoulders as a repository for objects such as instruments, syringes and the like. Therefore, the support surface near the patient's shoulders will be wide enough to accommodate this common usage. As a result, the surgical team members must lean against the support surface and/or extend their arms outwardly so that all portions of the patient's body are within arm's length. In extreme instances, all portions of the patient's upper torso may not be accessible from a single side of the surgical table.

What is needed, therefore, is a surgical table that optimizes the usage of the space on the patient support surface and the surrounding floorspace and that is mobile and yet can be secured against movement when performing surgery.

SUMMARY OF INVENTION

In one embodiment of the present invention, a surgical table is provided that permits compact lateral tilting of a patient support surface for reducing the height of the patient support surface relative to the floor surface when the surgical table is in a fully lowered condition. In accordance with the principles of the invention, the surgical table includes a patient support surface having a longitudinal axis, a frame attached to the patient support surface, and a base having a support column and a support platform attached to the support column. The surgical table further includes a pair of four-bar linkage mechanisms that allow the frame and the patient support surface to tilt transversely generally about the longitudinal axis and relative to the support platform. Each of the four-bar linkage mechanisms includes a pair of link arms each having one end pivotally attached to the support platform and an opposite end pivotally attached to the frame.

In another embodiment, the surgical table can incorporate an ancillary support surface for small instruments and the like, which permits a reduction in width of the back section of the patient support surface. In accordance with the principles of the invention, the surgical table includes a base and a patient support surface mounted to the base. The patient support surface has a head section for supporting a patient's head and a longitudinal axis. The surgical table further includes a tray pivotally coupled to the head section of said patient support surface and angularly rotatable about an axis of rotation generally parallel to the longitudinal axis of the patient support surface. The tray has a first condition in which angular rotation of the tray about the axis of rotation is inhibited and a second condition in which the tray is rotatable angularly about the axis of rotation. In the first condition, the tray is capable of receiving and supporting a surgical instrument.

In yet another embodiment, the present invention provides a surgical table constructed to provide a mechanically-simple floor-locking mechanism. In accordance with the principles of the invention, the surgical table includes a patient support surface, a base having a base frame, a support column extending between the base frame and the support surface, and a carriage coupled for relative movement with the base frame. The carriage includes a plurality of spaced-apart rolling members so that the surgical table is selectively mobile and a pair of yokes each pivotally coupled to the base frame, each of the yokes carrying at least one of the rolling members. To that end, the surgical table further includes a lifting mechanism operative for transferring a lifting force to the yokes sufficient to move the yokes relative to the base frame. The lifting mechanism is capable of moving capable of moving the yokes relative to the base frame between a first position in which the carriage is movable on the rolling members and a second position in which the carriage is not movable on the rolling members.

Various additional advantages and features of the invention will become more readily apparent to those of ordinary skill in the art upon review of the following detailed description taken in conjunction with the accompanying drawings.

DETAILED DESCRIPTION

Figure 1:
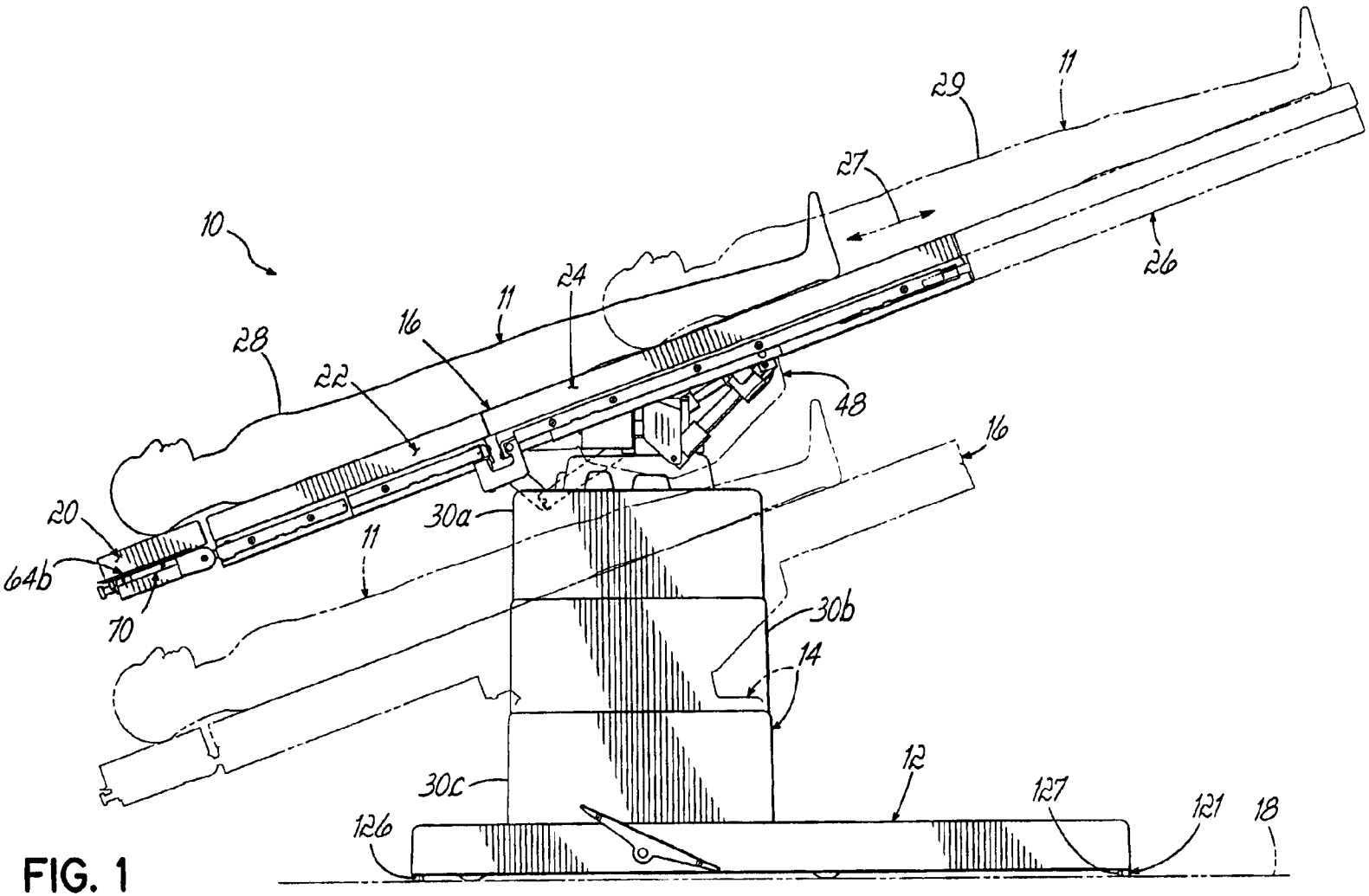
FIG. 1 is a side view of a surgical table of the present invention, shown tilted longitudinally in a Trendelenburg position and supporting a supine patient.

With reference to FIG. 1, a surgical table 10 of the present invention is shown with a patient 11 resting in a supine position. To serve as positional references hereinafter, the surgical table 10 shall be described as being "longitudinal" along its length and as being "transverse" across its width. The longitudinal end of the surgical table shown to the left in FIGS. 1 and 2 shall be referred to as the "head." The longitudinal end of the surgical table shown at the right in FIGS. 1 and 2 shall be termed its "foot." The transverse side of the surgical table facing the viewer in FIG. 1 shall be referred to as the "rear" and the opposite transverse side shall be referred to as the "front." The terms "head," "foot," "front," and "rear" shall be used hereinafter in a relative sense to assist in understanding the features and positions of the various elements of the surgical table but are not intended to be limiting of the present invention.

Figure 2:
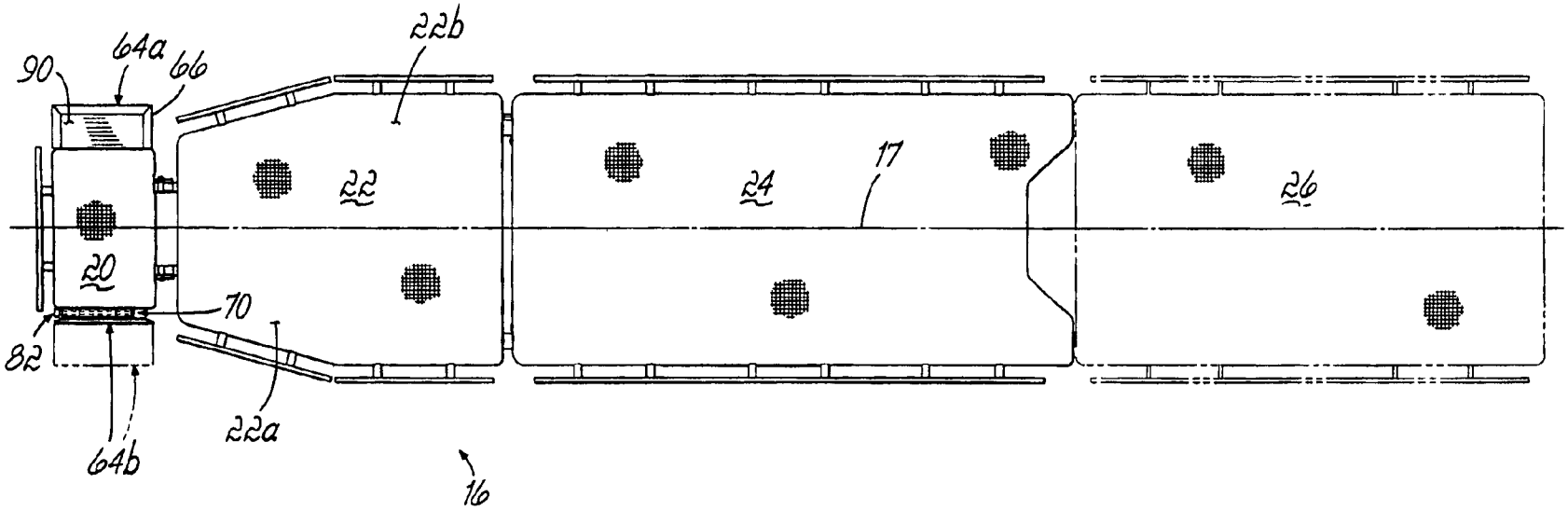
FIG. 2 is a top view of the surgical table of FIG. 1, shown without longitudinal tilting.

With reference to FIGS. 1 and 2, the surgical table 10 includes a base 12, a variable-height support column 14 extending vertically from the base 12, and a patient support surface 16 located at a variable height above a floor surface 18. The height of the patient support surface 16 is varied by vertical movement of the support column 14. The patient support surface 16 is formed of a plurality of, for example, four interconnected sections including of a head section 20, a back section 22, a leg section 24, and an extension section 26, each of which has a frame and a pad affixed to the frame. A longitudinal axis 17 extends in a longitudinal direction between the head and foot of the patient support surface 16.

Surgical table 10 is configured for performing a plurality of different surgeries. Specifically, the patient support surface 16 can be raised and lowered, the patient support surface 16 can be laterally tilted to the front and rear, the leg section 22 can be pivoted independently of the back section 22, the patient support surface 16 can be moved into the Trendelenburg (FIG. 1) and reverse Trendelenburg positions (not shown), and the patient support surface 16 can be moved into the flex and reflex positions. The mechanisms for providing the longitudinal tilting and relative pivoting of the individual sections of the patient support surface 16 are conventional.

During many operations, the patient 11 is moved along in a longitudinal direction, indicated on FIG. 1 by a double-headed arrow 27, of the patient support surface 16 from a normal orientation on the surgical table 10 in which patient 11 is supported on the head, back and leg sections 20, 22, 24 to an alternative orientation wherein the table 10 is reconfigured with the extension section 26 mounted to the foot end of the leg section whereby the leg section 24 supports the back of the patient 11 and the back section 22 supports the head of the patient 11. The normal orientation is indicated generally by reference numeral 28 (FIG. 1) and the alternative orientation is indicated generally by reference numeral 29 (FIG. 1).

The support column 14 is offset longitudinally parallel to longitudinal axis 17 from the center of the base 12 so that, when the patient 11 is at or near the second position 29, the surgical table 10 cannot tip longitudinally. When the patient 11 is in the first position 28, the base 12 does not restrict access to the patient's torso and head. In addition, the transverse dimension of the base 12 is significantly narrower than the transverse dimension of the patient support surface 16 so that surgical team members are afforded close access to the patient 11.

With continued reference to FIG. 1, the support column 14 is vertically extendable and is covered by a plurality of, for example, three telescoping cover sections 30*a*, 30*b* and 30*c*. The support column 14 is operable for raising and lowering the patient support surface 16 over a given travel range among various positions between a raised position of a maximum separation distance relative to floor surface 18 and a lowered position (shown in phantom in FIG. 1) of a minimum separation distance relative to floor surface 18. In one embodiment, the travel range of the patient support surface 16 is about 18 inches and the level height of surface 16 can be adjusted from a minimum separation distance of about 25½ inches to a maximum separation distance greater than the minimum separation distance of, for example, about 43½ inches, in which each separation distance is measured relative to a floor surface 18. A conventional mechanical mechanism provides the upward and downward vertical movement of the support column 14 among multiple positions bounded by the minimum and maximum separation distances.

With reference to FIGS. 3–7, the surgical table 10 includes a pair of four-bar linkage mechanisms 32, 34, each having four independent pivot points and four bars, and an actuating mechanism 36 operative for urging the four-bar linkage mechanisms 32, 34 for laterally tilting the patient support surface 16 relative to the longitudinal axis 17 (FIG. 2) and with respect to support column 14, which remains stationary during lateral tilting. The patient support surface 16 may also be tilted laterally from a horizontal condition to either the front or the rear by, for example, a lateral tilt angle of about 20°.

With continued reference to FIGS. 3–7, the actuating mechanism 36 includes a threaded rod or drive screw 38, a threaded sleeve or drive nut 40 through which drive screw 38 is threaded, and a reversible motor 42 which may rotatably operate a worm drive (not shown) that has a meshed relation with drive screw 38 in a conventional manner. The drive nut 40 is pivotally secured to a flange 44 mounted centrally on a support platform 46, which is disposed on an upper portion of the support column 14. Operation of motor 42 will cause rotation of the worm drive and, thereby, rotation of drive screw 38 relative to drive nut 40. The reversible motor allows bi-directional rotation of drive screw 38 relative to drive nut 40 for lateral tilting of the patient support surface 16 between to a first transversely-tired position (FIG. 6) having a given first tilt angle from a horizontal position (FIG. 5) toward the front of surgical table 10 or to a second transversely-tilted position (FIG. 7) having a given second tilt angle from horizontal toward the rear of surgical table 10. The first and second tilt angles are typically about 20°, which provides lateral tilting sufficient for surgical procedures. The actuating mechanism 36 is substantially surrounded by a protective cowling 48 having side skirts 48*a,b* (FIG. 4) on at least the front and rear sides, respectively, that project downwardly toward the floor 18. It is understood that any type of mechanical, electromechanical, hydraulic, or pneumatic mechanism may be employed without limitation in conjunction with the four-bar linkage mechanisms 32, 34 for laterally tilting the patient support surface 16.

With continued reference to FIGS. 3–7, the four-bar linkage mechanisms 32, 34 have a similar construction and the following discussion of four-bar linkage mechanism 34 is equally applicable to four-bar linkage mechanism 32. Attached to the underside of the leg section 24 (FIG. 1) of the patient support surface 16 is a frame 50 which is connected to the support platform 46 by a pair of link arms 52, 54. As can be appreciated, the support platform 46, the frame 50, and the pair of link arms 52, 54 collectively form four-bar linkage mechanism 34. One end of link arm 52 is pivotally coupled by a pivot pin 56 to one longitudinal end 49 of the support platform 46 and the opposite end of link arm 52 is pivotally coupled by a pivot pin 58 to one longitudinal end or rail 51*a* of the frame 50. Similarly, a pivot pin 60 pivotally couples one end of link arm 54 to the longitudinal end 49 of the support platform 46 with a transversely-spaced relationship relative to the pivotal attachment of link arm 52 by pivot pin 56 and a pivot pin 62 pivotally couples the opposite end of link arm 54 to rail 51*a* of the frame 50 with a transversely-spaced relationship relative to the pivotal attachment of link arm 52 by pivot pin 56. It is appreciated that the pivotal coupling of the link arms 52, 54 with support platform 46 and/or frame 50 may be direct, as illustrated in FIGS. 3–7, or indirect via another structural member (not shown), such as a mechanical linkage.

Pivot pins 56 and 58 provide pivotal points of attachment for link arm 52 and have respective longitudinal axes of rotation 56' and 58' that are aligned substantially parallel to the longitudinal axis 17 of patient support surface 16. Pivot pins 60 and 62 provide pivotal points of attachment for link arm 54 and have respective longitudinal axes of rotation 60' and 62' are aligned substantially parallel to the longitudinal axis 17 of patient support surface 16. In the level, horizontal condition shown in FIG. 5, the link arms 52, 54 are slanted outwardly in opposite transverse directions and at oblique angles from the vertical relative to the pivotal points of attachment at pivot pins 56, 60, respectively, to support platform 46.

Figure 3:
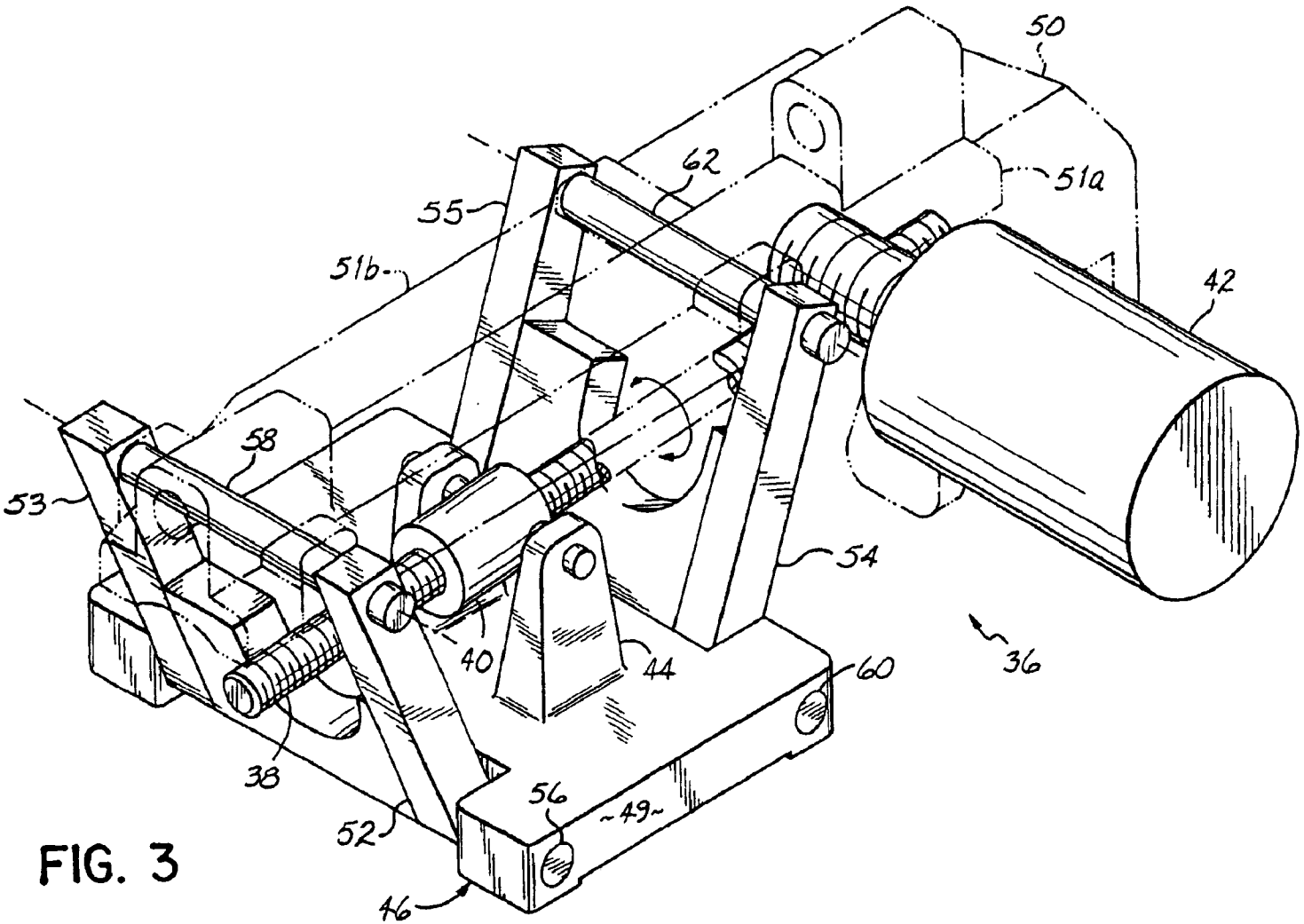
FIG. 3 is a perspective view of a portion of the surgical table of FIG. 1 showing the four-bar linkage mechanisms of the invention.
Figure 4:
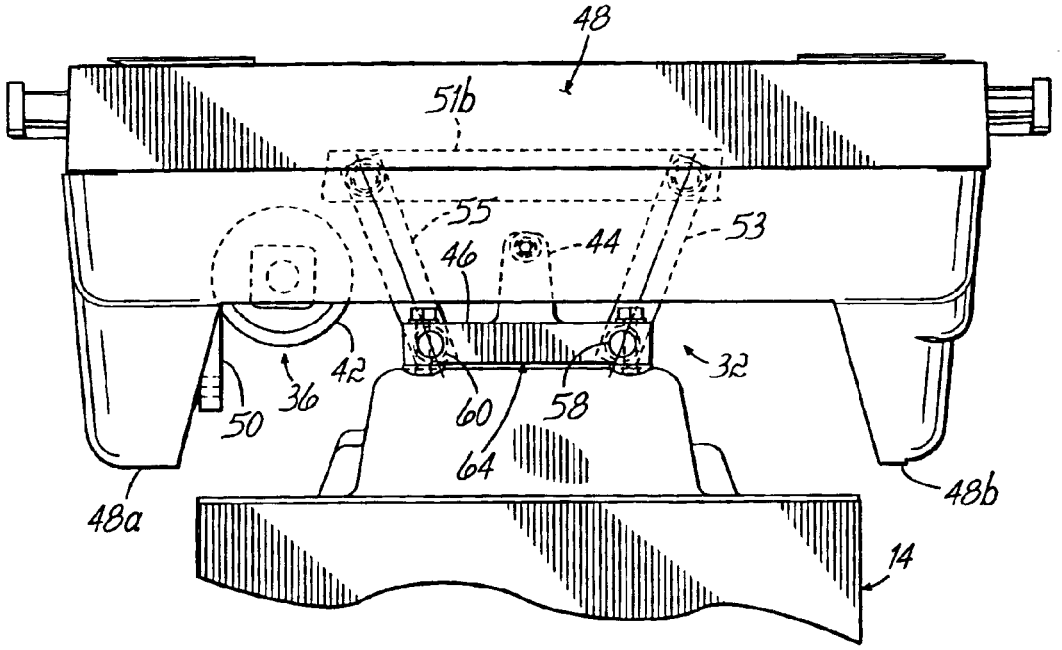
FIG. 4 is an end view of the surgical table of FIG. 3 as viewed from the foot of the surgical table.
Figure 5:
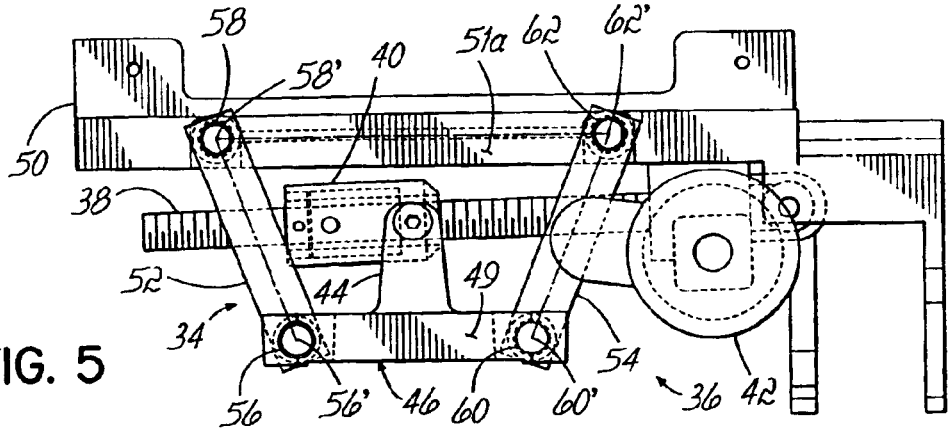
FIG. 5 is an end view of the surgical table of FIG. 3 as viewed from the head of the surgical table and in which the frame for the patient support surface is in a level, horizontal position and in which the patient support surface and cowling are removed.
Figure 6:
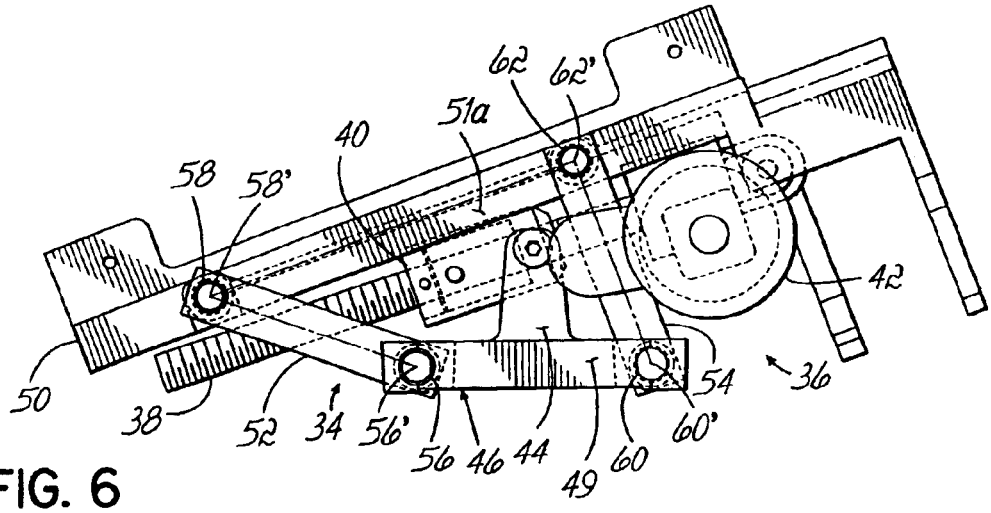
FIG. 6 is an end view similar to FIG. 5 in which the frame is laterally tilted in a first transverse direction.
Figure 7:
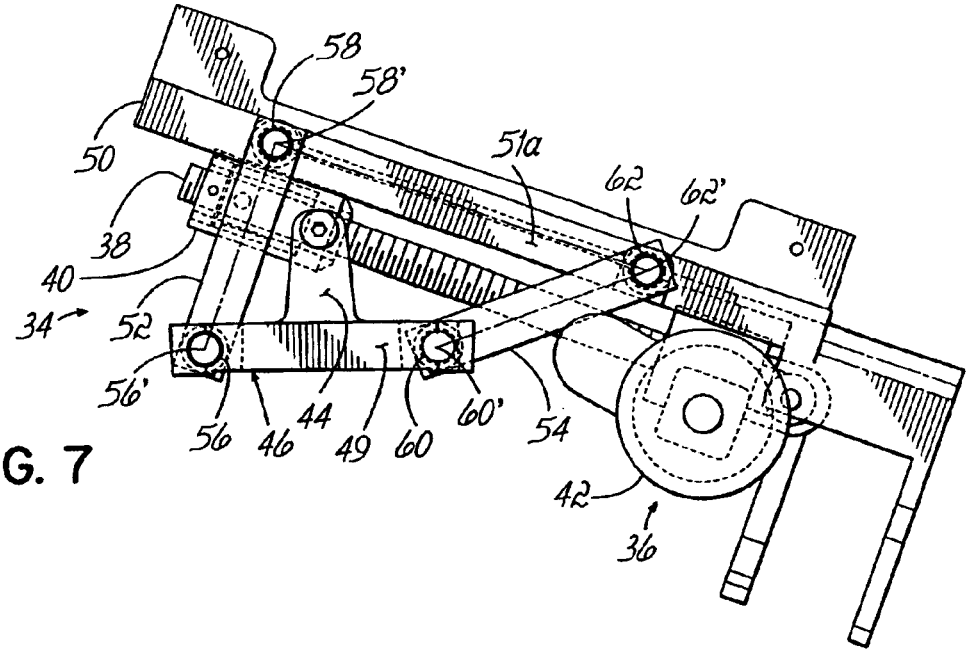
FIG. 7 is an end view similar to FIG. 6 in which the frame is laterally tilted in a second transverse direction.

With reference to FIGS. 3 and 4, four-bar linkage mechanism 32 has an identical construction to four-bar linkage mechanism 34. Specifically, four-bar linkage mechanism 32 includes a pair of link arms 53, 55 in which link arm 53 is pivotally coupled to support platform 46 by pivot pin 56, link arm 53 is pivotally coupled to frame 50 by pivot pin 58, link arm 55 is pivotally coupled to support platform 46 by pivot pin 60, and link arm 55 is pivotally coupled to a longitudinal end or rail 51*b* of frame 50 by pivot pin 62.

As evident in FIGS. 3–7, the four-bar linkage mechanisms 32, 34 permit the frame 50 and patient support surface 16 to move in a compact arcuate path relative to the support platform 46 so that the side skirts 48*a,b* (FIG. 4) do not contact the cover section 30*a* during the lateral tilting. The presence of the four-bar linkage mechanisms 32, 34 also limits the front-to-rear travel of the patient support surface 16 during lateral tilting by reducing the lateral extension of the frame 50 relative to the support platform 46. This maintains the patient support surface 16 near the center of gravity of the support column 14 and significantly reduces the likelihood that the surgical table 10 will tip transversely as the patient 11 is offset laterally from the vertical axis of the support column 14.

The presence of the four-bar linkage mechanisms 32, 34 between the frame 50 and the support platform 46 contributes to reducing the minimum separation distance of the patient support surface 16 relative to the floor 18. In one specific embodiment, the presence of the four-bar linkage mechanisms 32, 34 permits the patient support surface 16 to be lowered to within about 25½ inches from the floor 18, referenced relative to a horizontal condition and including the thickness of, for example, two-inch thick pads on the patient support surface 16 and the frame 50, while retaining the ability to laterally tilt the patient support surface 16 through a full range of lateral tilt angles. The ability to lower the patient support surface 16 to such a low height permits surgical team members to assume a sitting position when performing certain surgical procedures on the patient 11 so as to reduce fatigue. However, the range of vertical movement among multiple positions up to and including the maximum separation distance permits the patient support surface 16 to be raised for the surgical team members to stand when performing other surgical procedures.

In use, the patient support surface 16 is initially, for example, in the level, horizontal position illustrated in FIG. 4. The drive nut 40 of the actuating mechanism 36 is located at a central portion of the drive screw 38 and the link arms 52, 54 extend vertically outward from the attachments to the support platform 46 with approximately equal acute angles relative to the vertical. To laterally tilt the patient support surface 16 toward the front of the surgical table, the reversible motor 42 drives the drive screw 38 in a first rotational orientation relative to the stationary drive nut 40. Transverse movement of the drive screw 38 relative to the drive nut 40 causes the link arms 52, 54 of each four-bar linkage mechanism 32, 34 to articulate relative to the stationary support platform 46 and the frame 50. Specifically, link arms 52, 54 angularly rotate about pivot pins 58, 60, respectively, in a counterclockwise direction, when viewed normal to the plane of the page of FIG. 6, relative to the support platform 46. Link arm 52 inclines outwardly to increase the angle relative to the vertical beyond the initial acute angle. Link arm 54 rotates through a vertical orientation and then inclines inwardly. Because the support platform 46 is stationary, the actuating mechanism 36 tilts frame 50 and patient support surface 16 laterally in an arcuate path to a lateral tilt angle between, and inclusive of, horizontal and the fully laterally-tilted position shown in FIG. 6.

Similarly, the reversible motor 42 is operable to drive the drive screw 38 in a second rotational orientation, opposite to the first rotational orientation, relative to the stationary drive nut 40 to laterally tilt the patient support surface 16 toward the rear of the surgical table 10. Transverse movement of the drive screw 38 relative to the drive nut 40 causes the link arms 52, 54 of each four-bar linkage mechanism 32, 34 to articulate relative to the stationary support platform 46 and the frame 50. The frame 50 and patient support surface 16 move in an arcuate path relative to the support platform 46 to a lateral tilt angle less than or equal to the laterally-tilted position shown in FIG. 7.

Figure 15:
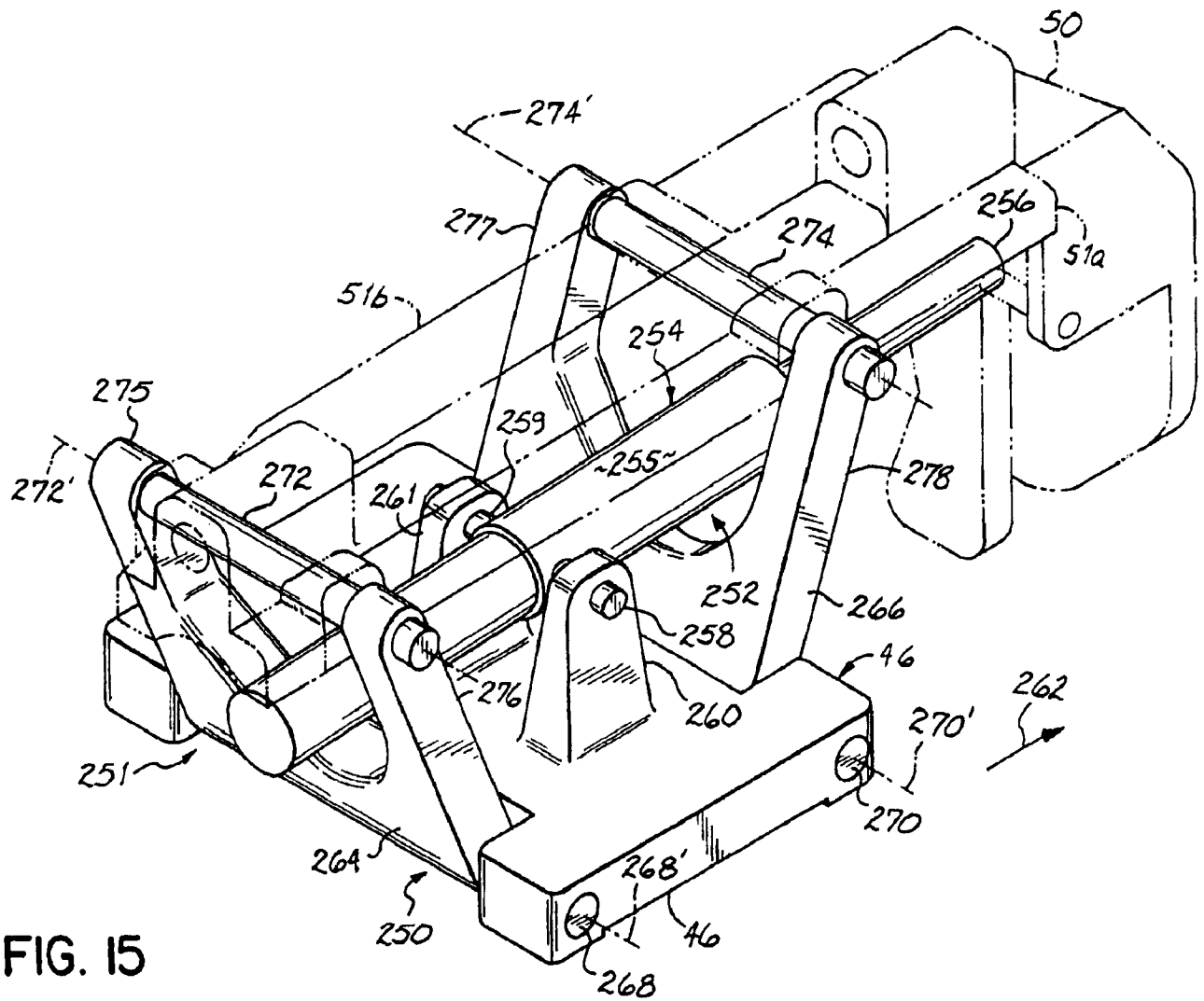
FIG. 15 is a perspective view of another embodiment of the four-bar linkage of the invention.

With reference to FIG. 15 in which like reference numerals refer to like features in FIGS. 3–7, another embodiment of surgical table 10 is provided that includes a pair of four-bar linkage mechanisms, indicated generally by reference numerals 250, 251, and an actuating mechanism 252 operative to urge the four-bar linkage mechanisms 250, 251 for laterally tilting the patient support surface 16 with respect to support column 14 (FIG. 2). The lateral tilting action of four-bar linkage mechanisms 250, 251 is substantially identical to the lateral tilting action described above with regard to four-bar linkage mechanisms 32, 34.

The actuating mechanism 252 is conventional and includes a double-action hydraulic cylinder 254 with a piston (not shown) movable inside a piston cylinder 255 and a piston rod 256 communicating the motion of the piston to the exterior of the piston cylinder 255. The piston cylinder 255 is pivotally secured by a pair of pins 258, 259 to a spaced-apart pair of flanges 260, 261 mounted centrally on support platform 46. The end of the piston rod 256 opposite the piston is coupled to the frame 50.

The actuating mechanism 252 includes a hydraulic pump (not shown) which selectively provides a regulated flow of pressurized hydraulic fluid into and out of a pair of internal chambers (not shown) of hydraulic cylinder 254. When the hydraulic pump, for example, forces hydraulic fluid into one internal chamber of hydraulic cylinder 254 and drains hydraulic fluid from the other internal chamber, the hydraulic pressure acting on the piston will cause the piston rod 256 to extend. Extension of the piston rod 256 generally in the direction of arrow 262 urges the four-bar linkage mechanisms 250, 251 and the frame 50 to laterally 111*t* in a first transverse direction, such as to the rear of the surgical table 10. Similarly, when the converse pumping and draining of hydraulic fluid from the internal chambers of hydraulic cylinder 254 occurs, piston rod 256 retracts in a direction generally opposite to arrow 262 so that the four-bar linkage mechanisms 250, 251 and the frame 50 are urged to laterally tilt relative to the support platform 46 in a second transverse direction opposite to the first transverse direction.

The four-bar linkage mechanisms 250, 251 include two yoke-shaped bars 264, 266, a pivot pin 268 pivotally attaching the bar 264 to the support platform 48, a pivot pin 270 pivotally attaching the bar 266 to the support platform 48, a pivot pin 272 pivotally attaching the bar 264 to the frame 50, and a pivot pin 274 pivotally attaching the bar 266 to the frame 50. Bar 264 includes a pair of longitudinally-spaced, vertically-extending link arms 275, 276 between which pivot pin 272 extends and, similarly, bar 266 includes a pair of longitudinally-spaced, vertically-extending link arms 277, 278 between which pivot pin 274 extends. The bars 264, 266 are formed as one-piece castings, which reduces the fabrication cost and strengthens the four-bar linkage mechanisms 250, 251. Pivot pin 268 is spaced in a transverse direction from pivot pin 270 and pivot pin 272 also has a transversely-spaced relationship relative to pivot pin 274.

Pivot pins 268 and 272 provide respective spaced-apart pivotal points of attachment for bar 264 and have respective longitudinal axes of rotation 268' and 272' are aligned substantially parallel to the longitudinal axis 17 of the patient support surface 16. Pivot pins 270 and 274 provide pivotal points of attachment for bar 266 and have respective longitudinal axes of rotation 270' and 274' aligned substantially parallel to the longitudinal axis 17 of the patient support surface 16. It is appreciated that the pivotal coupling of bars 264, 266 with support platform 46 and/or frame 50 may be direct, as illustrated in FIG. 15, or indirect via another structural member (not shown), such as a mechanical linkage.

With reference to FIGS. 2 and 8–10, the surgical table 10 includes a pair of articulating trays 64*a,b* pivotally attached along opposite transverse edges of the head section 20. Each articulated tray 64*a,b* is independently angularly rotatable about a longitudinal axis of rotation 83 (FIGS. 11A,B) by approximately 90° between a deployed position and a storage position, shown in phantom in FIG. 10. To that end, each articulated tray 64*a,b* has one condition in which angular rotation about longitudinal axis of rotation 83 is inhibited to provide the deployed position and another condition in which each tray 64*a,b* is rotatable angularly about axis 83 between the deployed and storage positions. In the deployed position, the trays 64*a,b* are substantially horizontal relative to the head section 20 such that surgical team members, such as the anesthesiologist, can place small objects such as instruments, syringes and the like, adjacent to the head of the patient. In the storage position, the trays 64*a,b* have been angularly rotated relative to the head section 20 so that the trays 64*a,b* are substantially perpendicular relative a plane containing head section 20.

Figure 8:
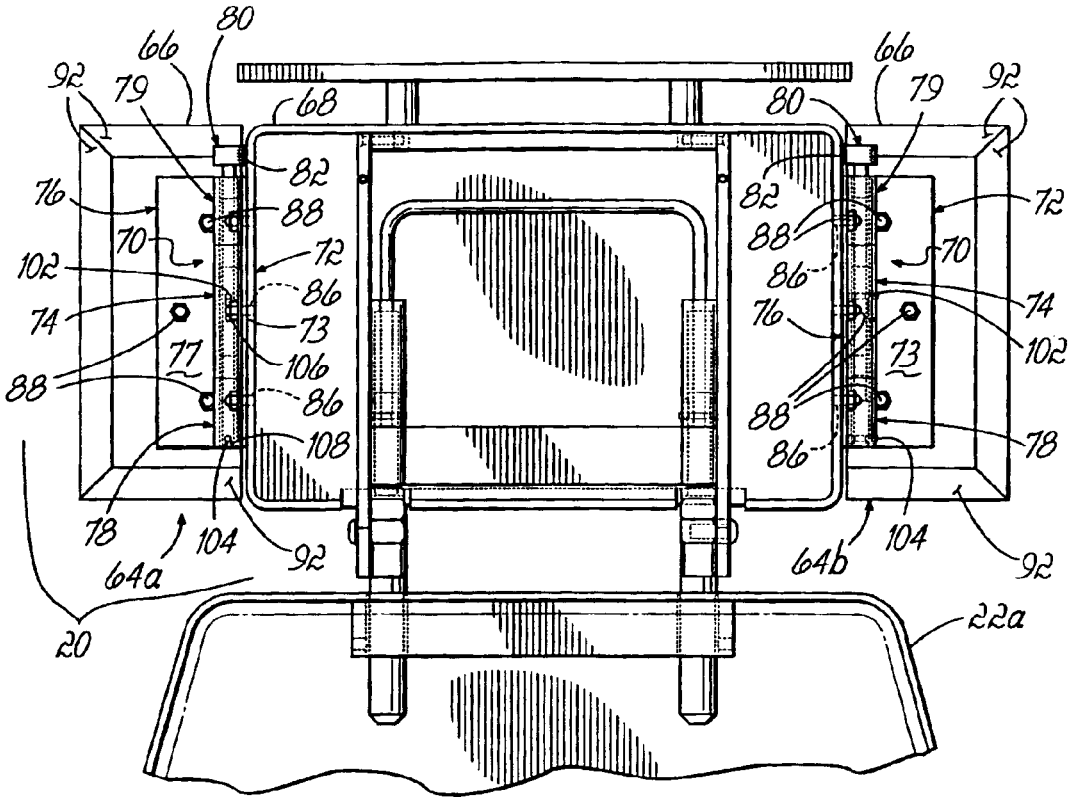
FIG. 8 is bottom view of a portion of the surgical table of FIG. 1.
Figure 9:
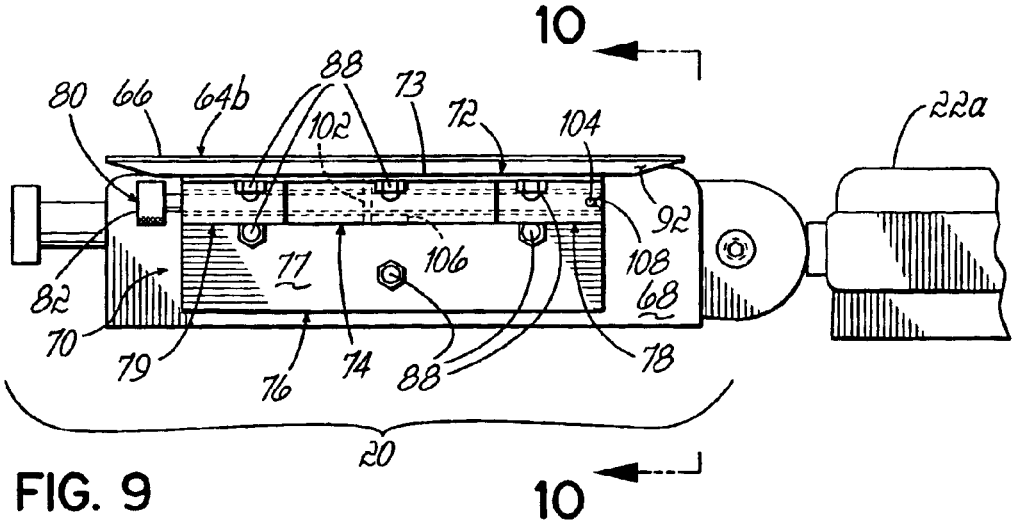
FIG. 9 is a side view of a portion of the surgical table of FIG. 1.
Figures 10, 11A, 11B:
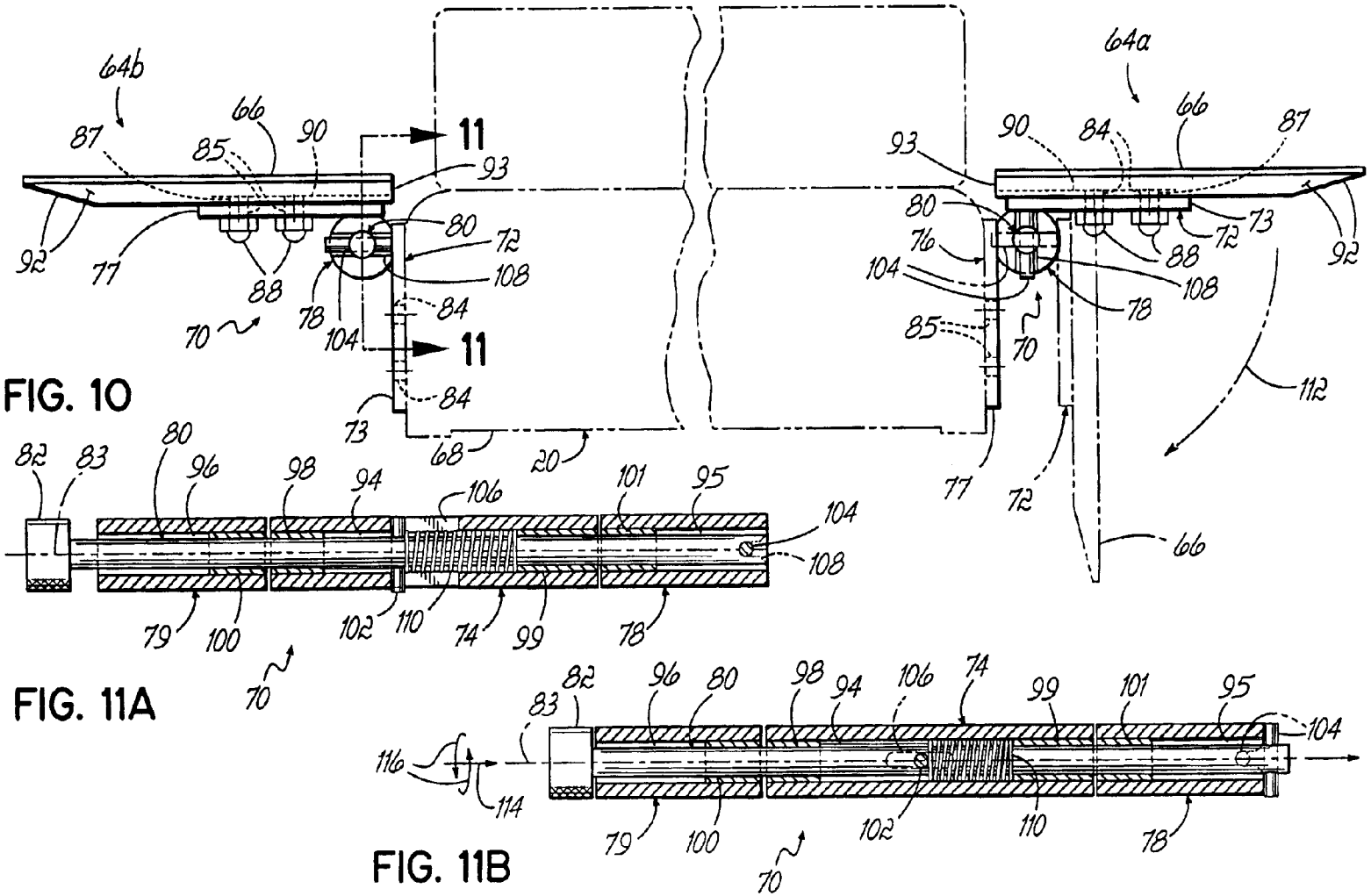
FIG. 10 is a cross-sectional view taken generally along line 10—10 of FIG. 9, in which the articulating trays are shown in a deployed position.
FIG. 11A is a cross-sectional view taken generally along line 11—11 of FIG. 10.
FIG. 11B is a cross-sectional view, similar to FIG. 11A, in which the articulating tray is rotated to a storage position.

With reference to FIGS. 8–10, each of the articulating trays 64*a,b* includes a panel 66 and a releasable latch mechanism 70 that pivotally attaches panel 66 to a frame 68. The releasable latch mechanism 70 includes a first hinge member 72 with a relatively flat first hinge pad 73, a second hinge member 76 with a relatively flat second hinge pad 77, and a hinge pin 80. A centrally-positioned knuckle or hinge arm 74 projects outwardly from the side edge of the first hinge pad 73. A pair of knuckles or hinge arms 78, 79 project outwardly in a common direction from the second hinge pad 77 in spaced-apart generally parallel relation to one another. The hinge pin 80 interrelates the hinge arms 78, 79 for angular rotation of hinge pad 77 relative to hinge pad 73, as will be described later, for pivoting the panel 66 between the deployed and storage positions. The hinge pin 80 includes a knob 82 that is utilized to provide a manual actuation force generally parallel to the longitudinal axis of rotation 83 (FIGS. 11A,B) of the hinge pin 80 that releases the actuated one of the articulating trays 64*a,b* for angular rotation about axis 83.

The hinge members 72, 76 of the releasable latch mechanism 70 are configured such that mechanism 70 can be utilized for pivotable attachment of either articulating tray 64*a* or articulating tray 64*b* relative to frame 68 so that knob 82 of each mechanism 70 faces the head of the surgical table 10. Hinge member 72 of front-side articulating tray 64*b* is secured with conventional fasteners 88 to a confronting side of frame 68 and hinge member 76 of front-side articulating tray 64*b* is secured with conventional fasteners 88 to panel 66 for the rear-side articulating tray 64*b*. Hinge member 72 of rear-side articulating tray 64*a* is secured with conventional fasteners 88 to a different confronting side of frame 66 and hinge member 76 of rear-side articulating tray 64*a* is secured with conventional fasteners 88 to panel 68 for the rear-side articulating tray 64*b*.

With continued reference to FIGS. 8–10, the latch mechanism 70 is reversible so that the same device may be utilized for use with either articulating tray 64*a* or articulating tray 64*b*. To that end, the bolt holes 84 on hinge pad 73, the bolt holes 85 on hinge pad 76, the bolt holes 86 on frame 68, and the bolt holes 87 on the panel 66 are arranged in identical symmetrical patterns so that either bolt holes 84 or bolt holes 85 can be aligned with the bolt holes 86 or with bolt holes 87 for fastening with conventional fasteners 88. The reversibility of the hinges pads 73, 77 provides manufacturing ease since only two distinct types of hinge pads are required to construct the releasable latch mechanism 70 for either of articulating trays 64*a, b*. Each of the trays 64*a,b* is oriented longitudinally such that the knob 82 of the hinge pin 80 faces the head of the patient support surface 16, which results in a longitudinal offset relative to the frame 68 as best shown in FIG. 8.

With reference to FIGS. 2 and 8–10, each panel 66 includes a generally planar work surface 90, a beveled side wall 92 extending about three sides of the work surface 90, and an open side 93. The beveled side wall 92 defines the outer or marginal boundaries of a recessed portion of work surface 90 which assists in preventing objects from rolling from, or being otherwise displaced from, the work surface 90. In other embodiments, side wall 92 may be omitted or an end wall (not shown) may close open side 92 to adjoin with side wall 92 so that the work surface 90 is surrounded by a continuous side wall.

As best shown in FIGS. 11A and 1B, hinge arm 74 includes a hollow, cylindrical bore 94, hinge arm 78 includes a hollow, cylindrical bore 95, and hinge arm 79 includes a hollow, cylindrical bore 96. In final assembled condition, bores 94–96 are axially aligned with one another and diametrically dimensioned as to receive the hinge pin 80 therethrough. Portions of the hinge pin 80 contact the cylindrical interior surfaces of a pair of annular bearing sleeves 98,99 provided inside the inner diameter of bore 94, an annular bearing sleeve 100 provided inside the inner diameter of bore 95, and an annular bearing sleeve 101 provided inside the inner diameter of bore 96. By this construction, the panel 66 and the hinge plate 77 pivot as a unit about the hinge pin 80 relative to the hinge plate 73 and the frame 68 of head section 20.

With reference to FIGS. 8–10, 11A and 11B, a guide projection 102 and a locking projection 104 project radially outwardly from an outer surface of hinge pin 80. The guide projection 102 is constrained to move longitudinally within the interior of an elongate slot 106 provided in hinge arm 74. The longitudinal dimension of the slot 106 determines the maximum range of longitudinal movement of the hinge pin 80. To that end, the knob 82 is spaced longitudinally apart from an end face of the hinge arm 79 in the deployed condition by a distance substantially equal to the longitudinal extent of travel of the hinge pin 80. The locking projection 104 projects radially outwardly from diametrically opposite sides of the hinge pin 80. The side wall surrounding the bore 96 of hinge arm 78 includes a pair of recess 108 that are dimensioned and configured to receive the locking projection 104. Each recess 108 is provided with a flared opening that facilitates capture of the locking projection 104. When the locking projection 104 is captured within the recesses 108, the hinge plates 73, 77 are secured against relative angular rotation and the appropriate one of the trays 64*a,b* is locked in the deployed position.

With reference to FIGS. 11A and 11B, a compression coil spring 110 is captured and compressed between a face of the bearing sleeve 99 and the guide projection 102. The compression coil spring 110 applies a restoring force or a biasing force that urges the hinge pin 80 linearly in a longitudinal direction so that the locking projection 104 is urged into the recesses 108 when each of trays 46*a,b* is in, at or near the deployed position. When either tray 46*a,b* is in a position other than the deployed position, the biasing force of the compression coil spring 110 urges the locking projection 104 to press linearly against the face of hinge arm 78 surrounding the entrance to bore 96. Characteristics of the compression coil spring 110, such as stiffness and free length, can be adjusted to select the magnitude of the biasing force.

In use and with reference to FIG. 10, the articulating tray 64*b* is in a deployed position so that a plane of panel 90 (FIG. 2) is substantially parallel to a plane containing the head section 20 and the opposite two ends of locking projection 104 are received within the flared recesses 108 in hinge arm 78 to provide a latched position for the hinge pin 80. The mechanical engagement between the locking projection 104 and the recesses 108 provides a positive rotation stop that secures the panel 90 and hinge pad 73 against rotation relative to the hinge pad 77 and locks the tray 64*b* in the deployed position. To release the tray 64*b* for angular rotation relative to the frame 68 in the direction of arrow 112 (FIG. 10), the knob 82 of the hinge pin 80 is depressed with a linear actuation force directed parallel to the longitudinal axis of rotation 83. The actuation force in the direction of arrows 114 (FIG. 11B) displaces the hinge pin 80 longitudinally in the hinge bores 94–96 relative to the hinge arms 74, 78 and 79 and compresses the compression coil spring 110. When the locking projection 104 is extended beyond the vertical plane of the circular end face of hinge arm 78, the locking projection 104 is no longer engaged with recesses 108 and hinge pin 80 assumes an unlatched position that provides the angularly rotatable condition of the tray 64*b*. As a result, the panel 90 and the hinge pad 73 of tray 64*b* are freed for collective angular rotation, as indicated generally by the arrows 116 in FIG. 11B, about longitudinal axis of rotation 83. The panel 90 and the hinge pad 73 are angularly rotatable in the sense of arrow 112 from the deployed condition to the storage condition. When the tray 64*b* is in the storage position, the panel 90 and hinge pad 73 are at approximately a right angle relative to hinge pad 77. The knob 82 is released to remove the linear actuation force and, as a result, the compression coil spring 110 expands slightly. The expansion of the compression coil spring 110 applies an axial restoring force that urges the hinge pin 80 to move longitudinally in a direction opposite arrow 114. Longitudinal movement ceases when the locking projection 104 contacts the circular end face of hinge arm 78. During extension and return of the hinge pin 80, the guide projection 102 is engaged within slot 106 to ensure that the displacement of the hinge pin 80 is substantially longitudinal. The above procedure is reversed to angularly rotate the panel 90 and hinge pad 73 from the storage position to the deployed position in a direction opposite to arrow 112.

To that end, the knob 82 of the hinge pin 80 is depressed with a linear actuation force directed generally parallel to the longitudinal axis of rotation 83. The actuation force displaces the hinge pin 80 longitudinally in the hinge bores 94–96 relative to the hinge arms 74, 78 and 79 and compresses the compression coil spring 110. The panel 90 (FIG. 2) and the hinge pad 74 of tray 64*b* are then free to collectively rotate angularly about longitudinal axis of rotation 83. When the panel 90 and the hinge pad 77 are substantially horizontal and level relative to the head section 20, the two ends of locking projection 106 are generally aligned with the flared recesses 108 in hinge arm 78. The knob 82 is released to remove the linear actuation force and, as a result, the compression coil spring 110 expands. The expansion of the compression coil spring 110 applies a restoring force that urges the hinge pin 80 to move longitudinally. Longitudinal movement ceases when the locking projection 108 engages the recesses 108 and/or when the guide projection 102 abuts the side wall about slot 106. Engagement between portions of the locking projection 104 and recesses 108 provides a positive stop that secures the panel 90 and hinge pad 77 against rotation relative to the hinge pad 73 and locks the tray 46*b* in the deployed position. During extension and return of the hinge pin 80, the guide projection 102 is engaged within slot 106 to ensure that the displacement of the hinge pin 80 is substantially longitudinal.

With reference to FIGS. 2 and 8, the back section 22 of the patient support surface 16 has a substantially rectangular portion 22*b* and a portion 22*a* of a tapered transverse dimension that is disposed between the rectangular portion 22*b* and the head section 20. Specifically, the transverse dimension of the tapered portion 22*a* diminished in a longitudinal direction from the rectangular portion 22*b* to the head section 20. The tapering of portion 22*a* is attributed to the presence of the articulating trays 64*a,b*, which can support objects such as surgical tools, syringes and the like for use during surgery. The storage space provided by the trays 64*a,b* eliminates the necessity of positioning such objects on the back section 22 in the area between the patient 11 and the periphery of the back section 22. The tapered portion 22*a* affords surgical team members a higher degree of access and proximity to the torso of the patient 11 without sacrificing the ability to place needed objects near the patient's upper torso and head.

With reference to FIGS. 1 and 12–14, the surgical table 10 is provided with a transversely-spaced pair of lifting mechanisms 120 that operate to raise and lower a base frame 121 of base 12 (FIG. 1) relative to a rectangular carriage 122 carrying a set of, for example, four spaced-apart pivotal castors or rollers 124. Projecting downwardly from opposite longitudinal ends of the base frame 121 are respective ones of a pair of transverse flanges 126, 127. The base frame 121 has a raised position in which only the rollers 124 contact the floor 18 and a lowered position in which the floor 18 is contacted by a lower flat surface of each of transverse flanges 126, 127. In the raised position, the surgical table 10 is portable on the rollers 124. In the lowered position, the surgical table 10 is anchored to the floor 18 by the transverse flanges 126, 127 so that the patient support surface 16 is stationary during surgery.

Figure 12:
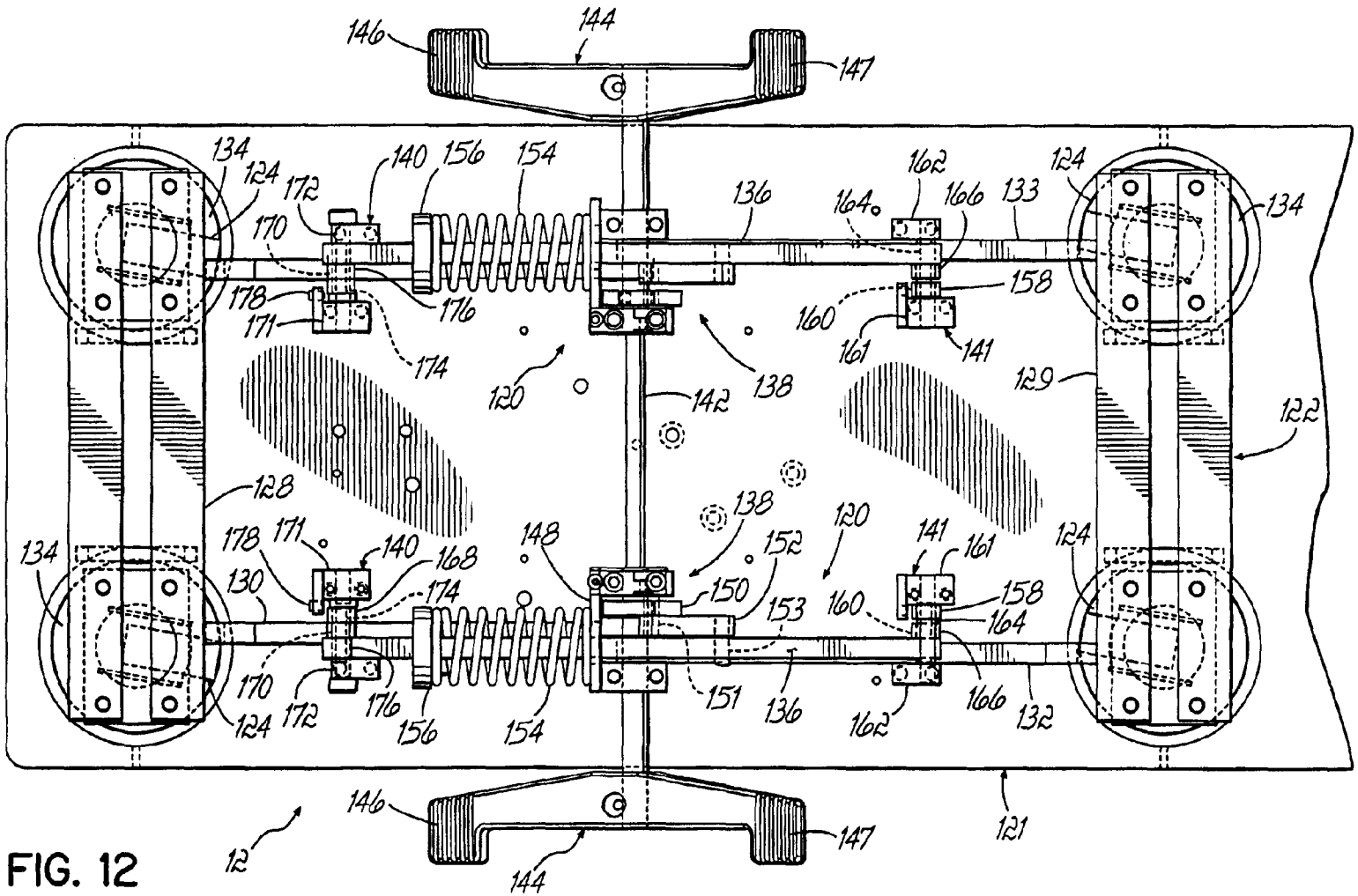
FIG. 12 is a top view of the base and associated lifting mechanisms of the surgical table of FIG. 1.

As best shown in FIG. 12, the carriage 122 includes a pair of transverse support beams 128, 129, a first pair of longitudinal support beams 130, 131 each having one end rigidly attached to transverse support beam 128 to form one yoke, and a second pair of longitudinal support beams 132, 133 each having one end rigidly attached to transverse support beam 129 to form a second yoke. Each roller 124 is attached at or near one corner of the carriage 122 and extends vertically through one of a plurality of four spaced-apart circular openings 134 in the base frame 121 so that each yoke carries two of the rollers 124.

Figure 13:
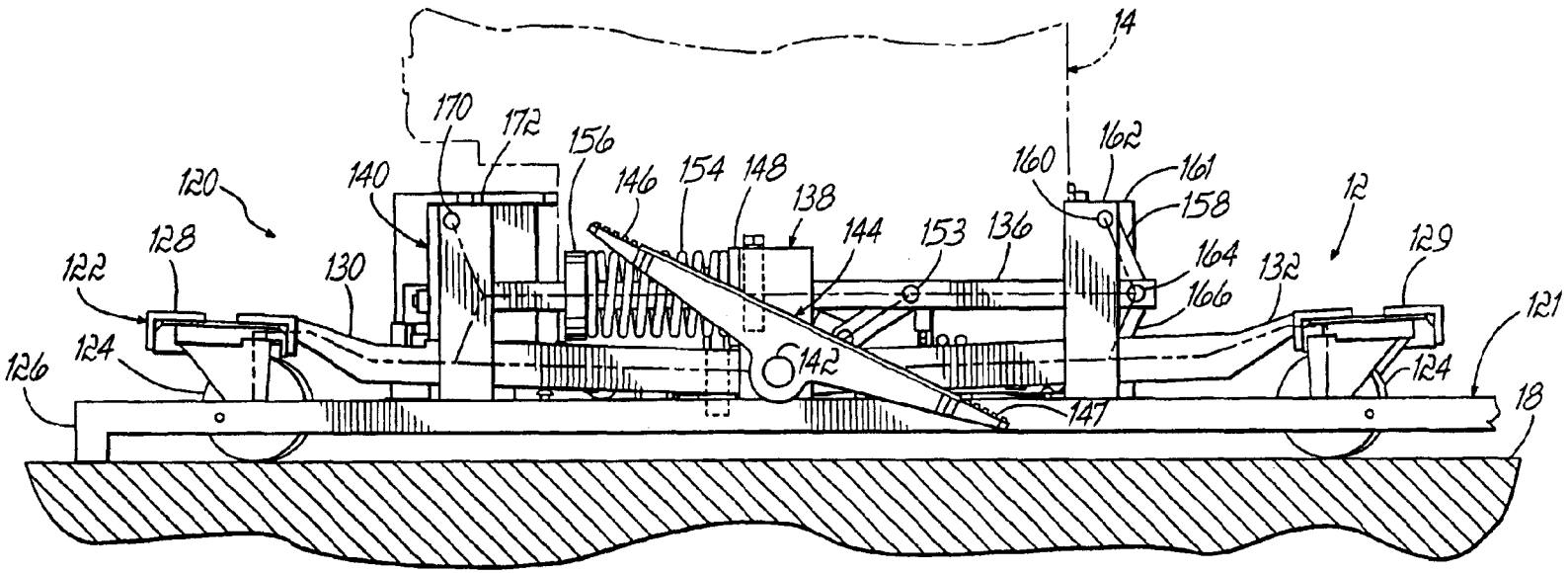
FIG. 13 is a side view of one of the lifting mechanisms of FIG. 12, in which the table is anchored to the floor by the lifting mechanisms of the invention.

With reference to FIGS. 12 and 13, each lifting mechanism 120 includes a longitudinally-movable bar 136, a central mechanical linkage 138, and two pairs of longitudinally-spaced mechanical linkages 140,141. A rotatable actuator rod 142 extends transversely between the central mechanical linkage 138 of each lifting mechanism 120. A lever 144 is mounted to each transverse end of the actuator rod 142 and manually controls the vertical movement of the base frame 121 relative to the carriage 122. To that end, each lever 144 is provided with an opposing pair of foot pedals 146, 147 used to move the base frame 121 between the raised and lowered positions, as diagrammatically illustrated in FIG. 14. When a force of a sufficient magnitude is applied to foot pedal 147, the base frame 121 moves downwardly toward the floor 18 so that the flanges 126, 127 engage the floor 18 and lock the position of the surgical table 10 relative to the floor 18 in the lowered position. Similarly, when a force of a sufficient magnitude is applied to foot pedal 146, the base frame 121 moves upwardly away from the floor 18 to the raised position so that the flanges 126, 127 are spaced from the floor 18 and the surgical table 10 is movable on the rollers 124.

Figure 14:
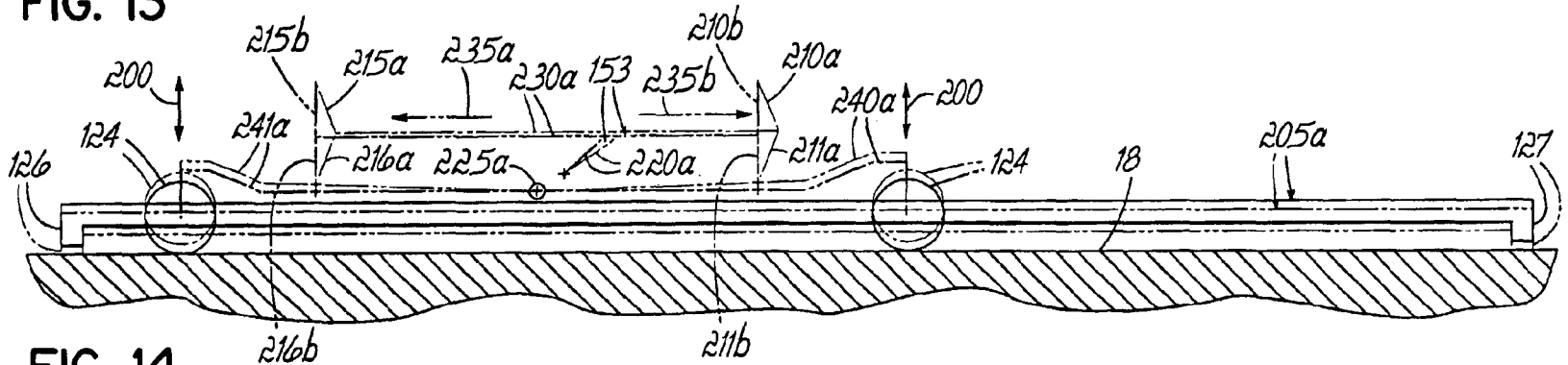
FIG. 14 is a schematic view of one of the lifting mechanisms which diagrammatically illustrates the raised and lowered positions of one of the lifting mechanisms of the invention.

With continued reference to FIGS. 13 and 14, one end of each longitudinal support beam 130–133 is rotatably attached to the actuator rod 142. The actuator rod 142 is mechanically coupled to each longitudinally-movable bar 136 by the pair of transversely-spaced mechanical linkages 138. Each mechanical linkage 138 includes a bracket 148, an L-shaped plate 150 having one end rigidly attached to the actuator rod 142, and another end pivotally attached by a pivot pin 151 to one end of a connecting arm 152. An opposite end of the connecting arm 152 is pivotally coupled by a pivot pin 153 with one of the bars 136. The actuator rod 142 extends transversely between the front and rear of the surgical table 10 through aligned openings provided in each of the brackets 148. Rotation of the actuator rod 142 by a manual force applied to one of the levers 146, 147 urges both of the bars 136 to move contemporaneously in a longitudinal direction. A compression spring 154 is positioned coaxially about each bar 136 between the bracket 148 and a collar 156 which is rigidly attached about the outer circumference of bar 136. When compressed by longitudinal movement of the bar 136 to provide the lowered position, the compression spring 154 urges the collar 156 longitudinally in a direction away from the bracket 148 so to provide mechanical assistance when restoring the surgical table 10 to the raised position.

Continuing to refer to FIGS. 13 and 14, one end of the each longitudinally-movable bar 136 is pivotally coupled to the base frame 121 by mechanical linkage 140. The opposite end of bar 136 is pivotally coupled to the base frame 121 by mechanical linkage 141. Mechanical linkage 141 includes an upper link arm 158 having one end rotatably attached by a shaft 160 to a transversely-spaced pair of support flanges 161, 162 extending upward from their respective attachment points to the base frame 121. An opposite end of upper link arm 158 is pivotally coupled by a pivot pin 164 to one end of a lower link arm 166. An opposite end of the lower link arm 166 is rotatably attached to longitudinal support beam 132. The pivot pin 164 also rotatably couples bar 136 to the upper and lower link arms 158, 166. The upper and lower link arms 158, 166 are relatively pivotal about the attachment to the bar 136 and extend radially from the pivot pin 164. Mechanical linkage 140 includes an upper link arm 168 having one end rotatably attached by a shaft 170 to a transversely-spaced pair of support flanges 171, 172 extending upward from their respective attachment points to the base frame 121. An opposite end of upper link arm 168 is pivotally coupled by a pivot pin 174 to one end of a lower link arm 176. An opposite end of the lower link arm 176 is rotatably attached to longitudinal support beam 132. The pivot pin 174 also rotatably couples bar 136 to the upper and lower link arms 168, 176. The upper and lower link arms 168, 176 are relatively pivotal about the attachment to the bar 136 and extend radially from the pivot pin 174. Mechanical linkages 140, 141 each include an adjustable stop 178 that limits the range of longitudinal travel of bar 136 when the base frame 121 is moved from the lowered position to the raised position.

In use and with reference to FIGS. 12–14, the base frame 121 is vertically movable relative to the carriage 122 as diagrammatically indicated by double-headed arrows 200 (FIG. 14). Normally, the surgical table 10 is stored in the lowered position and locked to the floor 18 by the engagement of the transverse flanges 126, 127 of the base frame 121. The base frame 121 is diagrammatically represented in FIG. 14 by reference numeral 205*a*. In the lowered position, the upper link arm 158 and lower link arm 166, represented in FIG. 14 respectively by reference numerals 210*a* and 211*a*, of mechanical linkage 141 are inclined with respect to each other. The upper link arm 168 and lower link arm 176, represented in FIG. 14 respectively by reference numerals 215*a* and 216*a*, of each pair of mechanical linkage 0.140 are inclined with respect to each other. The L-shaped plate 150 and connecting arm 152, collectively represented in FIG. 15 by reference numeral 220*a*, extend from the rotatable attachment to actuator rod 142, represented in FIG. 14 by reference numeral 225*a*, to the attachment to longitudinally-movable bar 136, represented in FIG. 14 by reference numeral 230*a*. Lever 144 is in the inclined position shown in FIG. 13.

To establish the raised condition and engage the rollers 124 with the floor 18, lever 144 is rotated counterclockwise, as viewed in FIG. 13, by applying force of a sufficient magnitude to pedal 146. This rotates the actuator rod 142 and L-shaped plate 150 counterclockwise. Connecting arm 152 is moved with a component of longitudinal displacement so that the bar 136 moves longitudinally in the direction of arrow 235*a*. The upper and lower link arms 210*a*, 211*a* pivot relative to each other to a substantially vertical alignment, as indicated by reference numerals 210*b*, 211*b*. Similarly, the upper and lower link arms 215*a*, 216*a* pivot relative to each other to a substantially vertical alignment, as indicated by reference numerals 215*b*, 216*b*. In response, the longitudinal beams 130, 132, represented in FIG. 14 by reference numerals 240*a*, 241*a*, rotate counterclockwise about their attachment to the actuating rod 142. As the longitudinal beams 130, 132 rotate, the base frame 121 moves vertically relative to the carriage 122, which has the effect of moving rollers 124 vertically so that the flanges 126, 127 of the base frame 121 are spaced from the floor 18 and the surgical table is rollingly supported on the rollers 124. To lower the flanges 126, 127 to engage the floor 18, the above procedure is reversed so that bar 136 is moved in the longitudinal direction diagrammatically illustrated by arrow 235*b*.

While the present invention has been illustrated by a description of various preferred embodiments and while these embodiments have been described in considerable detail in order to describe the best mode of practicing the invention, it is not the intention of the applicant to restrict or in any way limit the scope of the appended claims to such detail. Additional advantages and modifications within the spirit and scope of the invention will readily appear to those skilled in the art. The invention itself should only be defined by the appended claims, Wherein I claim:

1. A surgical table comprising:

a patient support surface;

a base having a base frame;

a support column extending between said base frame and said support surface;

a carriage coupled for relative movement with said base frame, said carriage including a plurality of spaced-apart rolling members and a pair of yokes each pivotally coupled to said base frame, each of said yokes carrying at least one of said rolling members; and a lifting mechanism operative for transferring a lifting force to said yokes sufficient to move said yokes relative to said base frame, said lifting mechanism capable of moving said yokes relative to said base frame between a first position in which said carriage is movable on said rolling members and a second position in which said carriage is not movable on said rolling members.

2. The surgical table of claim 1 wherein said base frame has a longitudinal axis and a transverse axis, and said base frame includes a longitudinally-spaced pair of transversely-extending flanges projecting downwardly therefrom, said flanges engaging the ground in the second position for inhibiting rolling movement of said rolling members.

3. The surgical table of claim 1 wherein said lifting mechanism includes a pair of linkages coupling said base frame with said carriage, each of said linkages including a movable bar, a first pair of relatively pivotal link arms at a first end of said bar and a second pair of relatively pivotal link arms at a second end of said bar opposite said first end, each of said first and said second relatively pivotal link arms pivotally coupling said bar with one of said yokes, said bar movable to orient said first and said second relatively pivotal link arms in a first orientation which provides said first position and a second orientation that provides said second position.

4. The surgical table of claim 3 wherein said base frame includes a rotatable actuator to which said pair of yokes are pivotally coupled, said rotatable actuator having a lever operative to move said bar for rotating said pair of linkages between said first and second orientations and thereby operative to move said yokes relative to said base frame between said first and second positions.

5. The surgical table of claim 3 wherein said lifting mechanism includes a pair of compression springs each applying a biasing force to a corresponding one of said linkages biasing said linkages in a direction from said second orientation to said first orientation, said biasing force effective to assist in moving said yokes relative to said base frame from said second position to said first position.

6. The surgical table of claim 5 wherein each of said compression springs is positioned coaxially about said movable bar of a corresponding one of said pair of linkages.

7. The surgical table of claim 3 wherein said first and said second relatively pivotal link arms are aligned in said first orientation and inclined relative to each other in said second orientation.

8. The surgical table of claim 1 wherein said base frame is positioned between said yokes and a surface contacted by said rolling members when said yokes are moved relative to said base frame to said first position.

9. The surgical table of claim 8 wherein said base frame includes a plurality of openings, each of said rolling members moving within a corresponding one of said openings when said yokes are moved relative to said base frame between said first and second positions.

* * * * *

UNITED STATES PATENT AND TRADEMARK OFFICE

CERTIFICATE OF CORRECTION

PATENT NO. : 6,886,199 B1
DATED : May 3, 2005
INVENTOR(S) : Gary G. Schwaegerle

It is certified that error appears in the above-identified patent and that said Letters Patent is hereby corrected as shown below:

Column 1,
Line 52, after “patient” insert -- is --.
Line 57, change “dose” to -- close --.
Line 58, change “that” to -- than --.

Column 2,
Line 60, delete the second occurrence of “capable of moving”.

Column 3,
Line 1, change “DRAWING” to -- DRAWINGS --.
Line 23, after “is” insert -- a --.

Column 4,
Line 5, after “including” delete “of”.

Column 5,
Line 23, after “between” delete “to”.
Line 24, change “tired” to -- titled --.

Column 6,
Line 4, after “62’” insert -- that --.

Column 7,
Line 54, change “111t” to -- tilt --.

Column 8,
Line 15, after “272” insert -- that --.

Column 9,
Line 42, change “1B” to -- 11B --.

Column 10,
Line 4, change “recess” to -- recesses --.
Lines 17 and 18, change “46” to -- 64 --.

Column 11,
Line 25, change “46” to -- 64 --.

UNITED STATES PATENT AND TRADEMARK OFFICE

CERTIFICATE OF CORRECTION

PATENT NO. : 6,886,199 B1
DATED : May 3, 2005
INVENTOR(S) : Gary G. Schwaegerle

It is certified that error appears in the above-identified patent and that said Letters Patent is hereby corrected as shown below:

Column 12,
Line 49, after “so” insert -- as --.
Line 52, delete “the”.

Column 13,
Line 27, change “linkage” to -- linkages --.
Line 27, change “0.140” to -- 140 --.

Signed and Sealed this

Eighth Day of November, 2005

JON W. DUDAS
*Director of the United States Patent and Trademark Office*